US009102886B1

(12) United States Patent
Schmidt

(10) Patent No.: US 9,102,886 B1
(45) Date of Patent: Aug. 11, 2015

(54) MIXER FOR REMOVING IMPURITIES FROM GASES AND LIQUIDS

(71) Applicant: Tex-OK-Kan Oilfield Services, LLC, Garden City, KS (US)

(72) Inventor: Chris J. C. Schmidt, Garden City, KS (US)

(73) Assignee: Tex-Ok-Kan Oilfield Services, LLC, Garden City, KS (US)

( * ) Notice: Subject to any disclaimer, the term of this patent is extended or adjusted under 35 U.S.C. 154(b) by 0 days.

(21) Appl. No.: 14/669,957

(22) Filed: Mar. 26, 2015

(51) Int. Cl.

| | |
|---|---|
| ***C10L 3/10*** | (2006.01) |
| ***B01F 3/04*** | (2006.01) |
| ***B01J 10/00*** | (2006.01) |
| ***B01F 5/06*** | (2006.01) |
| ***B01F 15/00*** | (2006.01) |
| ***B01F 13/00*** | (2006.01) |

(52) U.S. Cl.
CPC ..... *C10L 3/103* (2013.01); *B01F 3/04262* (2013.01); *B01F 5/061* (2013.01); *B01F 13/0016* (2013.01); *B01F 15/00883* (2013.01); *B01F 15/00922* (2013.01); *B01F 2215/0036* (2013.01); *C10L 2230/14* (2013.01); *C10L 2290/24* (2013.01); *C10L 2290/544* (2013.01); *C10L 2290/567* (2013.01); *C10L 2290/60* (2013.01)

(58) Field of Classification Search
CPC ..... C10L 3/10; C10L 3/101; B01F 5/0602; B01F 3/04; B01F 3/04503; B01F 5/061; B01J 10/00
See application file for complete search history.

(56) References Cited

U.S. PATENT DOCUMENTS

| | | | | |
|---|---|---|---|---|
| 3,912,469 | A | 10/1975 | Ewan et al. | |
| 3,966,438 | A | 6/1976 | Nicholson | |
| 4,073,832 | A | 2/1978 | McGann | |
| 4,141,701 | A | 2/1979 | Ewan et al. | |
| 4,497,942 | A * | 2/1985 | Yeboah et al. | 528/12 |
| 6,136,282 | A | 10/2000 | Fisher | |
| 6,346,361 | B1 * | 2/2002 | Shan et al. | 430/168 |
| 6,562,247 | B2 * | 5/2003 | Gillis et al. | 210/799 |
| 7,408,059 | B2 * | 8/2008 | Kobayashi et al. | 544/2 |
| 7,544,340 | B2 | 6/2009 | Jamal et al. | |
| 7,550,032 | B2 | 6/2009 | Brouwers et al. | |
| 7,619,104 | B2 * | 11/2009 | Clements | 554/174 |
| 8,057,579 | B2 | 11/2011 | Molaison | |

(Continued)

FOREIGN PATENT DOCUMENTS

| | | | |
|---|---|---|---|
| CN | 202460436 | U | 10/2012 |
| CN | 103127818 | A | 6/2013 |

(Continued)

*Primary Examiner* — Timothy Vanoy
(74) *Attorney, Agent, or Firm* — Craig Buschmann; Brinks Gilson & Lione

(57) ABSTRACT

A vessel for mixing a fluid with a reagent as the fluid flows through the vessel includes a vessel wall that encloses an interior volume. The vessel includes a first end, a second end spaced, and an axis that extends from the first end to the second end. The axis is configured to intersect and form an angle with a reference plane. The vessel also includes a fluid inlet proximate the first end through which the fluid enters the interior volume, a fluid outlet proximate the second end through which the fluid exits the interior volume, a port through which the reagent enters the interior volume, and at least one packing material positioned within the interior volume between the fluid inlet and the fluid outlet. The packing material randomly distributes the fluid and the reagent as the fluid flows through the vessel from the fluid inlet towards the fluid outlet.

19 Claims, 6 Drawing Sheets

(56) References Cited

U.S. PATENT DOCUMENTS

| | | | | |
|---|---|---|---|---|
| 8,858,679 | B2 | 10/2014 | Buhrman et al. | |
| 8,899,557 | B2 | 12/2014 | Cullinane et al. | |
| 8,905,080 | B2 * | 12/2014 | Mascarello et al. | 138/42 |
| 2002/0014154 | A1 | 2/2002 | Witzko et al. | |
| 2005/0182255 | A1 * | 8/2005 | Kobayashi et al. | 544/2 |
| 2013/0195730 | A1 * | 8/2013 | Ohya et al. | 422/162 |

FOREIGN PATENT DOCUMENTS

| | | | |
|---|---|---|---|
| CN | 203018000 | U | 6/2013 |
| JP | 2014-205775 | A | 10/2014 |
| WO | WO 2014/116310 | A1 | 7/2014 |

* cited by examiner

MIXER FOR REMOVING IMPURITIES FROM GASES AND LIQUIDS

BACKGROUND

The present invention relates to vessels for mixing a fluid with a reagent, catalyst or other chemical.

Typically, when natural gas or other hydrocarbons are produced from a well, the gas and hydrocarbons must undergo some initial treatment to make it suitable for transportation in pipelines and other methods of conveyance. This treatment may include the removal of water, brine, and/or other impurities that may be produced concurrently with the natural gas and hydrocarbons.

For example, it is not uncommon for natural gas to include anywhere from trace amounts to high concentrations of hydrogen sulfide gas ($H_2S$) or other impurities. In the case of $H_2S$, it is inflammable, toxic to people, and corrosive to many metals. Because of its corrosive effects on metals, most pipeline operators establish maximum concentrations of $H_2S$ that are permissible in any feed stock introduced into their pipelines. Thus, any excess $H_2S$ must be removed from natural gas before it can be transported via these pipelines.

Typically, and in the case of $H_2S$, stripping agents or strippers are mixed with the natural gas produced from a well. This mixing typically occurs in a stripping tower, typically a vertical tower. The natural gas is introduced at the bottom and allowed to travel upward while the stripping agent is introduced near the top of the tower and allowed to travel downward. The natural gas and the stripping agent interact in the tower, thereby lowering the concentration of $H_2S$ within the natural gas that exits near the top of the tower. Optionally, mechanical agitators may be included as part of the tower to affect the reaction of the natural gas with the stripping agent.

These vertical towers, however, require a large footprint and typically are fixed installations. Thus, they are expensive to manufacture and maintain. This cost, in turn, tends to be prohibitive for those wells that produce relatively smaller amounts of natural gas. Further, energy to power mixers and agitators may be limited at a well site.

Thus, there is need for a relatively lower cost mixing vessel that reduces or eliminates the need for an electrical source of power and relies upon passively created pressure gradients and "static" mixing (i.e., without the use of powered pumps or mixers). Further, there is a need for a mixer that has a smaller footprint than others known in the art. In particularly, there is a need for mixers that can be mounted to a pallet and transported to a well site for use singly or in series with other similar mixers.

BRIEF SUMMARY

A vessel for mixing a fluid with a reagent as the fluid flows through the vessel includes a vessel wall having an outer surface and an inner surface spaced apart from the outer surface, thereby enclosing an interior volume. The vessel includes a first end, a second end spaced apart from the first end, and an axis that extends from the first end to the second end. The axis is configured to intersect and form an angle with a reference plane, wherein the angle is between zero degrees and 20 degrees. The vessel also includes a fluid inlet proximate the first end through which the fluid enters the interior volume, a fluid outlet proximate the second end through which the fluid exits the interior volume, a port through which the reagent enters the interior volume, and at least one packing material positioned within the interior volume between the fluid inlet and the fluid outlet, the packing material configured to randomly distribute the fluid and the reagent as the fluid flows through the vessel from the fluid inlet towards the fluid outlet.

In another embodiment, a vessel for mixing a fluid with a reagent as the fluid flows through the vessel includes a vessel wall having an outer surface and an inner surface spaced apart from the outer surface. The vessel wall is configured to enclose an interior volume. The vessel includes a first end positioned a first height above a reference plane, a second end spaced apart from the first end, the second end being positioned a second height above the reference plane, and an axis that extends from the first end to the second end. A fluid inlet is proximate the first end through which the fluid enters the interior volume and a fluid outlet is proximate the second end through which the fluid exits the interior volume. At least one reagent enters the interior volume through a port. A first packing material and at least a second packing material are positioned within the interior volume between the fluid inlet and the fluid outlet. Each of the first packing material and the second packing material have a first end having a packing material inlet and a second end spaced apart from the first end, the second end having a packing material outlet. The packing material outlet of the at least second packing material is positioned asymmetrically relative to the packing material outlet of the first packing material.

In an embodiment of a method of using the disclosed vessels includes mixing a natural gas that includes an impurity at a first concentration with a stripping agent that reacts with the impurity so as to reduce the first concentration of the impurity within the natural gas to a second concentration. The mixing occurs within a vessel having a first end and a second end spaced apart from the first end. The method includes introducing the natural gas into an interior volume of the vessel through a fluid inlet proximate the first end of the vessel, introducing the stripping agent into the interior volume of the vessel through a port, and passing the natural gas and the stripping agent into a first packing material via a first packing material inlet and out of the first packing material via a first packing material outlet. The method further includes passing the natural gas and the stripping agent into at least a second packing material via a second packing material inlet and out of the second packing material via a second packing material outlet oriented asymmetrically relative to the first packing material outlet. The method then removes the natural gas from the interior volume via a fluid outlet port positioned downstream of the second packing material. In some embodiments, the method comprises creating a pressure gradient within the natural gas between the first end and the second end of the vessel.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

DETAILED DESCRIPTION

Figure 1:
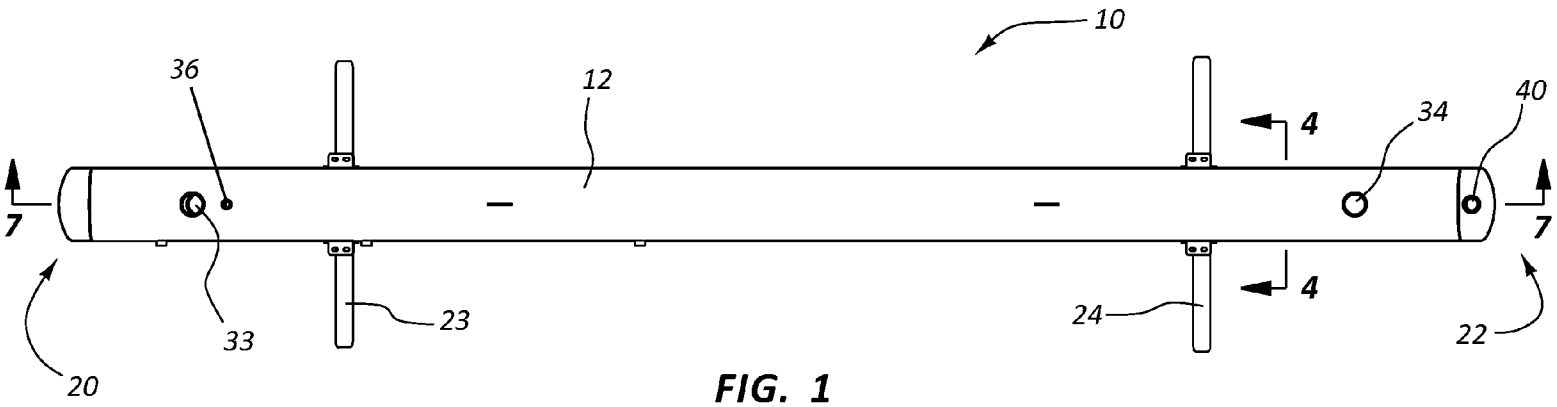
FIG. 1 is an embodiment is a top plan view of an embodiment of a mixer.
Figure 2:
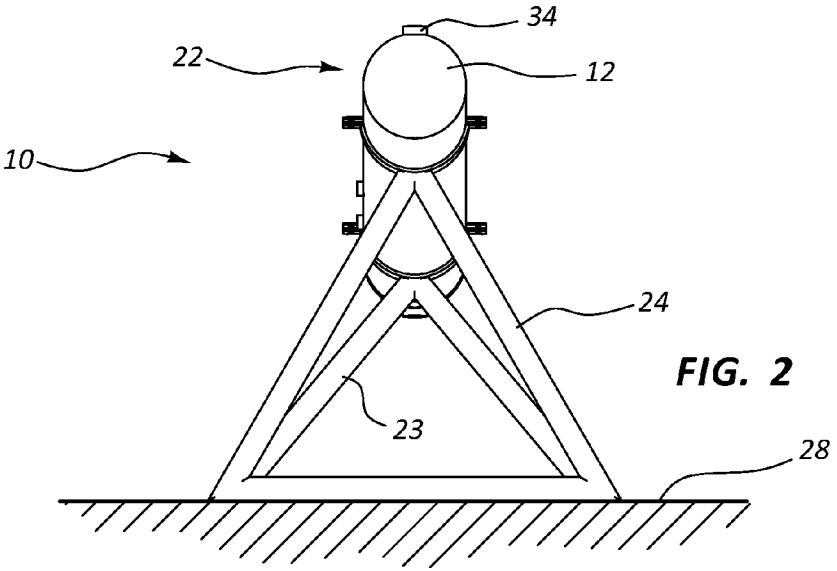
FIG. 2 is a side plan view of the mixer in FIG. 1.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Illustrated in FIGS. 1-7 is a vessel 10 for mixing a fluid with a reagent as the fluid flows through the vessel. The vessel is suitable for mixing any type of fluid, either liquid or gas, with one or more reagents, catalysts, fluids (liquid or gas), or solids.

As just one non-limiting example, the fluid may be a mixture of produced fluids from an oil or gas well. As is known, produced fluid from an oil or gas well typically includes fluids in a gaseous phase, a liquid phase, and sometimes both. The produced fluid often includes hydrocarbons with hydrocarbon chains of varying length. In addition, the produced fluid may contain water and, perhaps, other impurities such as hydrogen sulfide ($H_2S$).

The vessel 10 includes a vessel wall 12 having an outer surface 14 and an inner surface 16 spaced apart from the outer surface 14. The vessel wall 12 is configured to enclose an interior volume 18. The vessel wall 12 may be made of most known materials, and typically is formed of a metal that is non-reactive or minimally reactive with any fluids and reagents within the interior volume, or is otherwise provided with special treatments and/or coatings to protect the metal. For example, the inner surface 16 of the vessel wall 12 optionally includes a coating that provides protection to the vessel wall 10 from the fluid and any reagent present within the interior volume 18. The vessel 10 also includes a first end 20 and a second end 22 spaced apart from the first end 20.

Optionally, the vessel wall 12 may be jacketed with elements (not illustrated) that either heat or cool the outer surface of the vessel wall 12. The heating or cooling elements may be used to more precisely control the temperature and, consequently, any temperature dependent reactions, within the interior volume 18 of the vessel 10.

Figure 3:
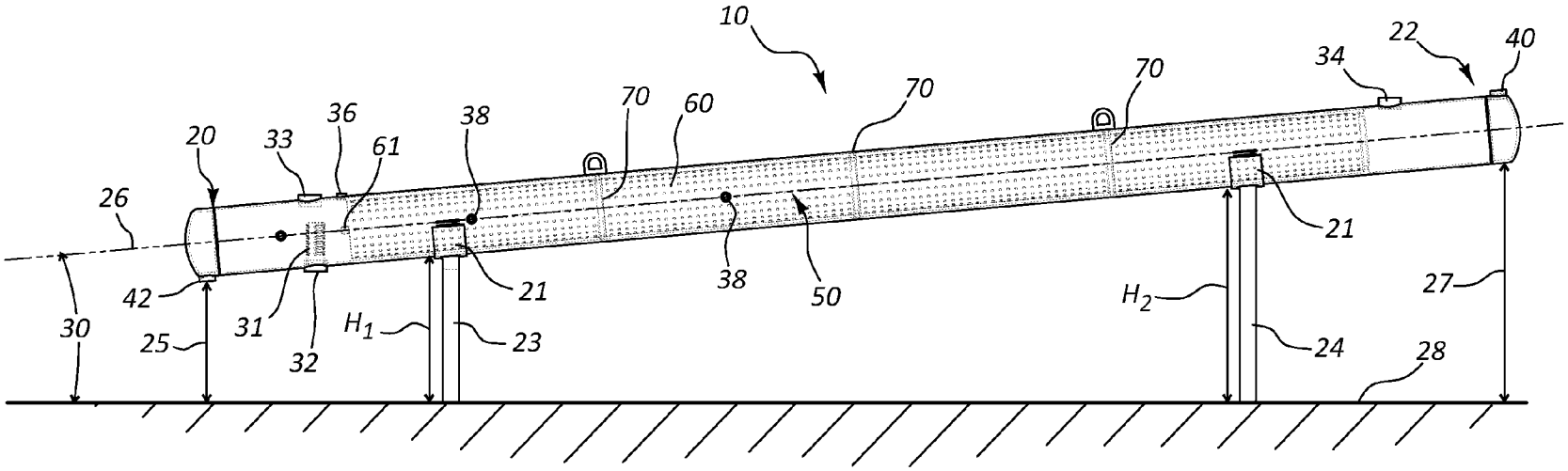
FIG. 3 is a side plan view of the mixer in FIG. 1 with the interior components indicated in outline.
Figure 4:
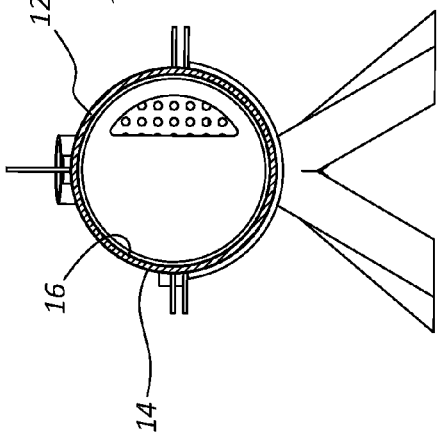
FIG. 4 is a cross-section 4-4 of the mixer in FIG. 1.

The vessel 10 optionally includes one or more legs that support and, in some instances, are coupled to the outer surface 14 of the vessel wall 12. As illustrated, the vessel 10 includes a first leg 23 proximate the first end 20 and a second leg 24 spaced apart from the first leg 23 and, in this instance, proximate the second end 22. Each leg 23, 24, optionally includes a cradle 21 to support the vessel 10. The cradle 21 may be coupled to the outer surface 14 of the vessel wall 12 via brackets, as illustrated. The height $H_1$ of the first leg 23 is less than the height $H_2$ of the second leg 24 as measured from a reference plane 28. In most instances, the reference plane 28 is the ground, a concrete pad, or other typically level surface, such as a frame, upon which the vessel is mounted. Consequently, the first end 20 of the vessel 10 is positioned a first height 25 above the reference plane 28 and the second end 22 is positioned a second height 27 above the reference plane 28, as illustrated in FIG. 3. Of course, one will understand that the opposite can be true (i.e., $H_1$ is greater than $H_2$), or that the heights of the legs 23, 24 can be the same. The legs 23, 24 are illustrated as triangular bar stock, but can be of any shape and made of any material.

An axis 26 (FIGS. 3 and 7) extends from the first end 20 to the second end 22. The axis 26 is configured to intersect and form an angle 30 with the reference plane 28. The angle 30 is between zero degrees inclusive and 20 degrees, inclusive. More preferentially, the angle 30 is between 5 degrees inclusive, and 15 degrees, inclusive, and yet still more preferentially, the angle 30 is between 8 degrees inclusive, and 12 degrees, inclusive. Positioning the vessel 10 at an angle 30 creates a pressure gradient within the interior volume 18 of the vessel 10 without the use of mixers, agitators, pumps, or other mechanical systems. Further, the angle 30 and the consequent pressure gradient is a function of the rate at which the fluid and reagent interact. In other words, the angle 30 can be optimized as a function of the mass-balance equation between the fluid and the reagent.

It is noted that while the pressure gradient primarily is created passively as described above, the vessel 10 may include pumps, agitators, and mixers (not illustrated) to create and/or maintain a pressure gradient and to further enhance the mixing of the fluid and the reagent as described below.

The vessel 10, as illustrated, is an elongated cylinder, with a length along the axis 26 much greater than its width or diameter between the top and the bottom of the vessel. Of course, the vessel 10 can include other dimensions and shapes, including spherical, square, rectangular, and others.

The vessel 10 includes fluid inlet 32 proximate the first end 20 through which the fluid enters the interior volume 18. Optionally, the vessel 10 includes an auxiliary fluid inlet 33 also typically proximate the first end 20 and through which the fluid or another fluid or reagent may enter the interior volume 18. Optionally, a diffuser 31 is coupled to at least one of the fluid inlet 32 and the auxiliary fluid inlet 33. The diffuser 31 diffuses the fluid passing through the fluid inlet 32, for example, over a greater area and more randomly than would otherwise occur without the diffuser 31. Once passing through the vessel 10, the treated fluid exits the interior volume 18 through a fluid outlet 34 proximate the second end 22.

The vessel 10 also optionally includes at least one of a pressure relief valve 40 typically positioned proximate the second end 22 to relieve excess pressure during atypical circumstances, and a fluid drain 42 typically positioned proximate the first end 20 to empty the vessel 10 for maintenance and before transporting the vessel 10.

A port 36 permits the reagent to enter the interior volume 18. Typically, the port 36 is positioned proximate the first end 20, but it may be positioned elsewhere along the vessel 10.

The vessel 10 includes at least one of a fluid level detector, 38, which can include at least one of a fluid level sensor and a viewing port configured to provide a user with a level of the fluid within the vessel 10. A fluid level sensor may be of any type known in the art, while a viewing port may include an observation window through which a user may optically view the level of the fluid.

Within the vessel 10, at least one packing material 50 (FIGS. 9 and 10) is positioned within the interior volume 18 between the fluid inlet 32 and the fluid outlet 34. In some embodiments, the vessel 10 includes a first packing material 50 and at least a second packing material 50. The packing material 50 is configured to randomly distribute the fluid and the reagent as the fluid flows through the vessel 10 from the fluid inlet 32 towards the fluid outlet 34. The packing material 50 includes a first end 52 with a packing material inlet 53 and a second end 54 with a packing material outlet 55 spaced apart from the first end 52 as defined by the flow of fluid through the packing material 50 from the first end 52 to the second end 54. At least the packing material outlet 55 may be of any shape and orientation, include perforated screens or plates in which the perforations or openings are randomly positioned or concentrated in one portion or area of the outlet.

Optionally, the packing material outlet 55 of the at least second packing material 50 is positioned asymmetrically relative to the packing material outlet 55 of the first packing material 50. Positioning the outlets asymmetrically aids in redistribution the fluid and reagent about the interior volume 18, which better ensures mixing between the fluid and the reagent and reduces the risk of channeling of the flow of the fluid and/or reagent in such a way that reduces, and possibly prevents, mixing of the fluid and reagent.

Figure 9:
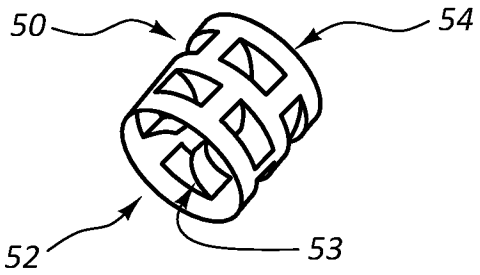
FIG. 9 is a perspective view of a packing material for use in the mixer in FIG. 1.
Figure 10:
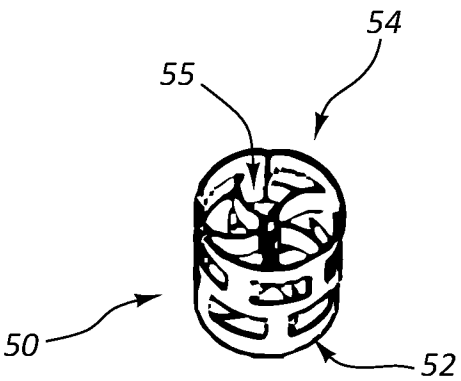
FIG. 10 is another perspective view of the packing material of FIG. 9.

The packing material 50 may be formed, typically, from a material that is minimally or non-reactive with the fluid and the reagent. For example, the packing material 50 may be of various types of plastics, non-reactive metals (e.g., stainless steel), ceramics, and other materials. Further, the packing material 50 may be of any shape, including spheres, oblong, and irregular shapes, provided that it assists in distributing the fluid and the reagent randomly within the interior volume 18 as the fluid and reagent travel between the fluid inlet 32 and the fluid outlet 34. Just a few, non-limiting examples of the packing material include at least one of a Pall ring as illustrated in FIGS. 9 and 10, Bialecki ring, Raschig ring, Intalox saddle, and Berl saddle, and any combinations of these packing materials as well as others.

Optionally, the vessel 10 includes a retention device, 60, that retains or maintains at least one of a position and an orientation of the packing materials 50 within the interior volume 18. For example the retention device 60, may be a wire, mesh, or perforated basket. As illustrated, the retention device 60 is cylindrical in shape to conform partly to the interior volume 18 of the vessel 10. Optionally, the retention device 60 includes a key that interacts with a complementary feature within or on the inner surface 16 of the vessel wall 12 to maintain the position and/or orientation of the retention device 60. Similarly, an optional cross-member 61 coupled to the interior surface 16 of the vessel wall 12 may act to at least position and/or orient at least one of the retention devices 60 within the interior volume 18.

Figure 5:
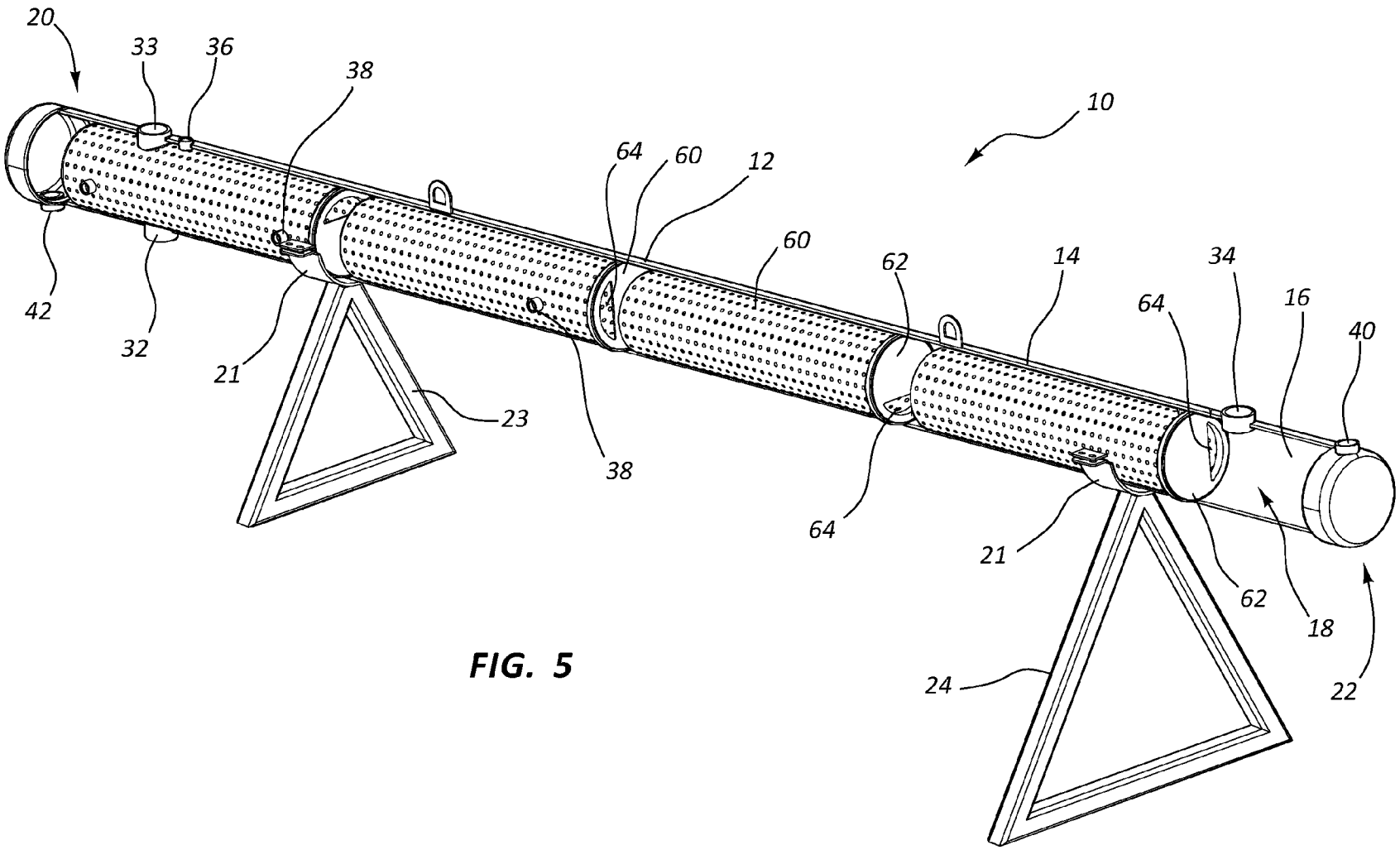
FIG. 5 is a cut-away, top perspective view of the mixer in FIG. 1.
Figure 6:
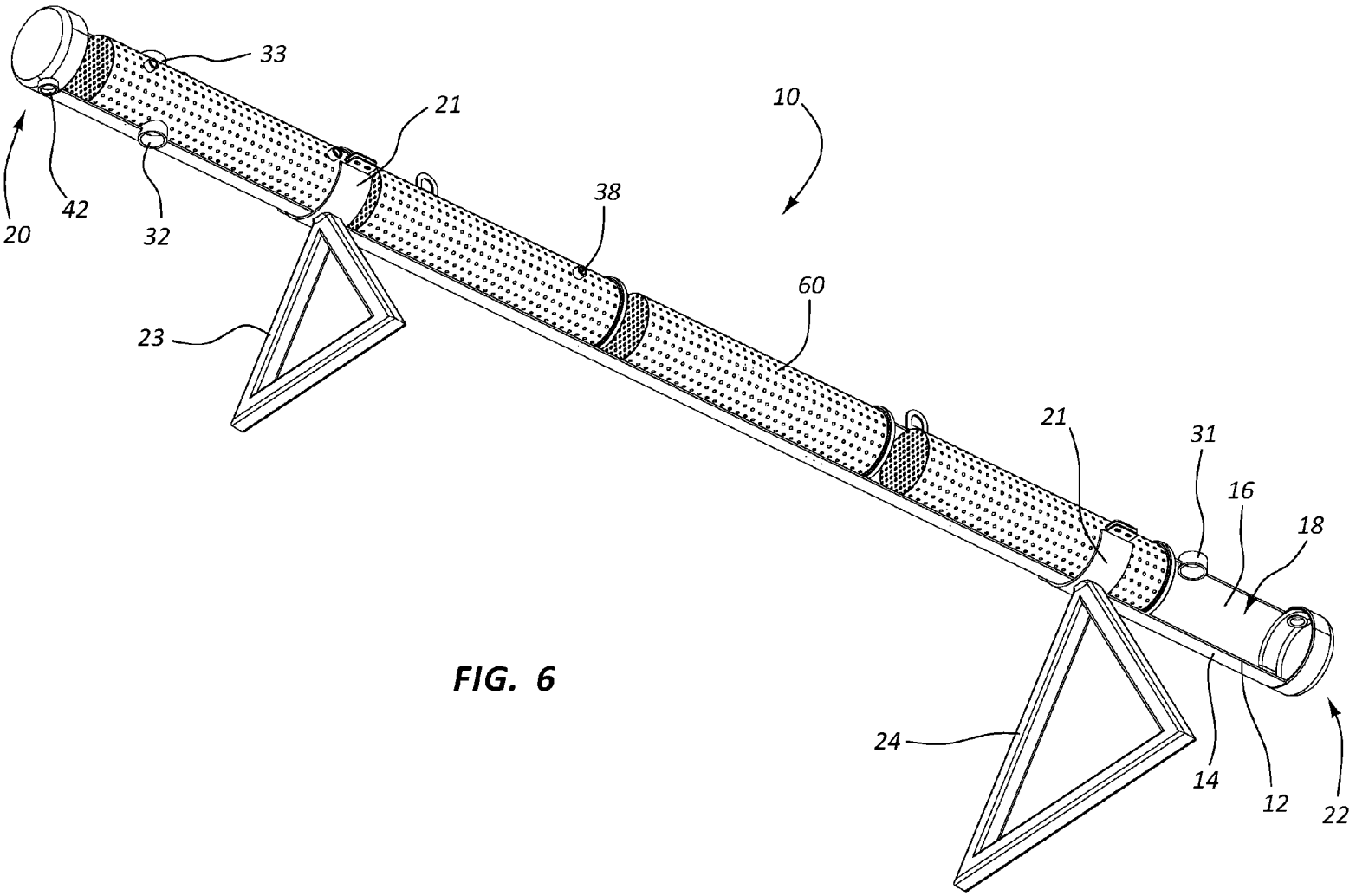
FIG. 6 is a cut-away, bottom perspective view of the mixer in FIG. 1.
Figure 7:
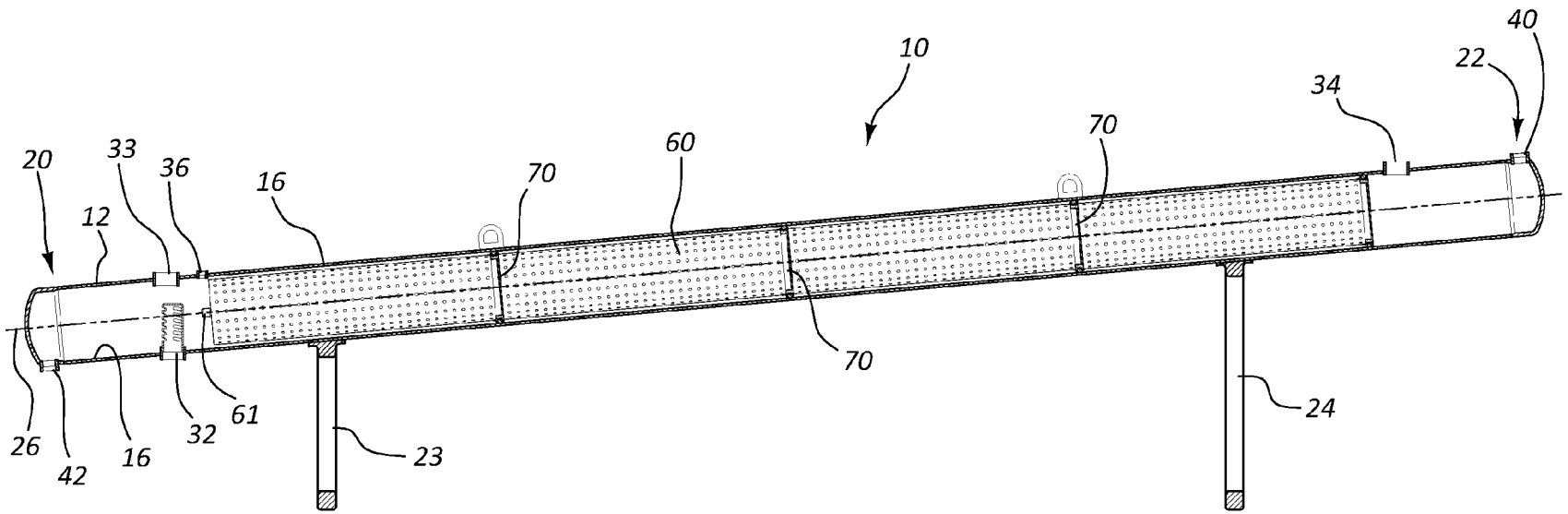
FIG. 7 is a cross-section 7-7 of the mixer in FIG. 1.
Figure 8:
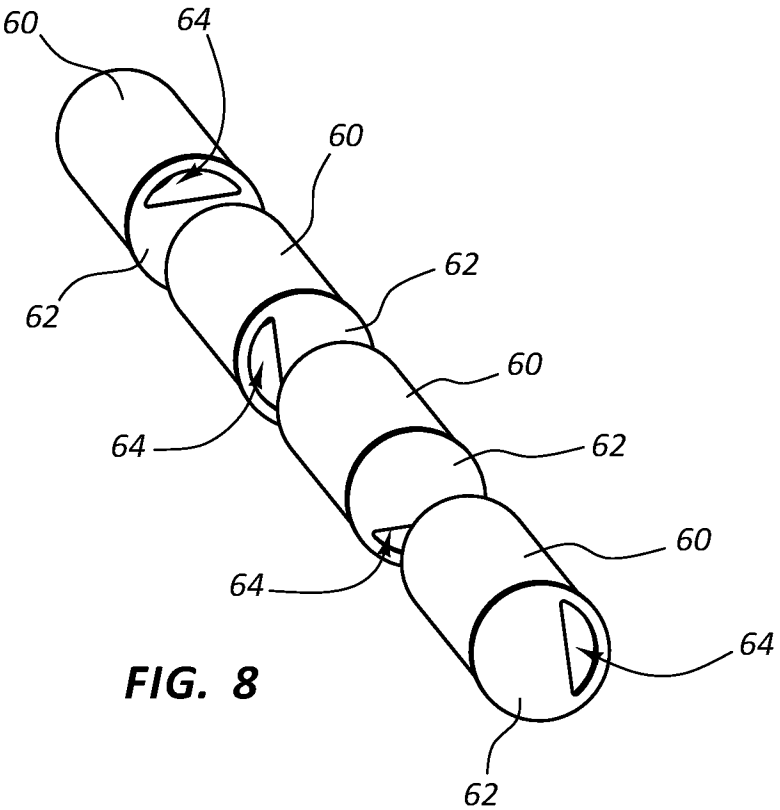
FIG. 8 is a view of several retention devices for use in the mixer in FIG. 1.

The retention device optionally includes at least an outlet plate 62 with at least one opening 64, as best illustrated in FIGS. 5 and 8. The outlet plate 62 may be integrally formed with the retention device 60 or may be a separate component coupled to the retention device 60. The opening 64 is asymmetric relative to the overall shape of the outlet plate 62.

As illustrated in FIGS. 5 and 8, the opening 64 is in the shape similar to that of a half-circle offset from the center line of the outlet plate 62. Alternatively, the opening 64 may be of any shape and orientation, including perforated screens or plates in which the perforations or openings are randomly positioned or concentrated in one portion or area of the outlet plate 62. In FIGS. 5 and 8, the openings 64 are orientated such that each opening 64 is asymmetric to the opening 64 of the adjacent retention device 60 and packing material 55. As illustrated, the openings 64 are each rotated 90 degrees relative to the opening 64 of at least one of the preceding and succeeding outlet plates 62. Other configurations to asymmetrically orient the openings 64 are of course possible, including rotating adjacent openings 64 either more or less than 90 degrees.

The opening 64 provides the same function as the packing material outlet 55, discussed above, in that the opening 64 asymmetrically aids in redistributing the fluid and the reagent about the interior volume 18, which better ensures mixing between the fluid and the reagent and reduces the risk of channeling of the flow of the fluid and/or reagent in such a way that reduces, and possibly prevents, adequate mixing of the fluid and reagent.

The outlet plate 62 may be used in addition to the packing material outlet 55 discussed above or as an alternative to the packing material outlet 55. In some instances, the outlet plate 62 may be coupled directly to or be incorporated into the packing material 50. Thus, in such an embodiment, the outlet plate 62 and the opening 64 actually comprise the packing material outlet 55.

The vessel 10 optionally includes a seal 70, such as a sealing ring. Typically, the seal or sealing ring 70 is positioned between at least one of adjacent retention devices 60 and packing materials 50. The sealing ring 70 helps to ensure the fluid and reagent flows through at least one of the packing material 50 and the retention device 60. The sealing ring 70 may be formed of metals—typically those that are non-reactive with the fluid and the reagent—elastomers, and other materials known to provide a seal.

With the structure of the vessel 10 explained, a non-limiting example of a method of mixing a fluid and a stripping agent or reagent are now discussed. While the method discussed is within the context of natural gas, particular natural gas as produced from a well, as the fluid treated within the vessel, it is understood that other fluids and treatments may be used with the vessel.

The method disclosed is for mixing a natural gas that includes an impurity at a first concentration with a stripping agent or reagent that reacts with the impurity so as to reduce the first concentration of the impurity within the natural gas to a second concentration. For example, the natural gas may include hydrogen sulfide, $H_2S$, which typically must be removed or reduced sufficiently in concentration within the natural gas to permit the natural gas to be handled more safely and to be transported within pipelines or other methods of conveyance without the restrictions or special accommodations that the presence of $H_2S$ ordinarily requires. The mixing occurs within a vessel 10 as described above.

The natural gas, or the fluid, is introduced into the interior volume 18 of the vessel 10 through a fluid inlet 32 proximate the first end 20 of the vessel 10. The stripping agent, such as an $H_2S$ stripping agent or scavenger, is introduced into the interior volume 18 of the vessel 10 through a port 36.

The natural gas and the stripping agent passes into a first packing material 50 via a first packing material inlet 52 and out of the first packing material 50 via a first packing material outlet 54. The natural gas and the stripping agent then passes into at least a second packing material 50 via a second packing material inlet 52 and out of the second packing material 50 via a second packing material outlet 54 oriented asymmetrically relative to the first packing material outlet 54. Optionally, the packing material 50 is retained within a retention device 60 as described above.

The natural gas and the stripping agent move through the interior volume 18 of the vessel 10 under the action of a pressure gradient created between the first end 20 and the second end 22 of the vessel 10. The pressure gradient may be created by positioning the first end 20 of the vessel 10 a first height 25 above the reference plane 28 and positioning the second end 22 of the vessel 10 a second height 27 above the reference plane 28. Alternatively, the pressure gradient may be created by causing an axis 26 that extends from the first end 20 to the second end 22 of the vessel 10 to intersect and form an angle 30 with the reference plane 28, wherein the angle 30 is between zero degrees and 20 degrees.

The natural gas with a reduced concentration of the impurity is then removed from the interior volume 18 of the vessel 10 via a fluid outlet port 34 positioned downstream of the second packing material 50.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A vessel for mixing a fluid with a reagent as the fluid flows through the vessel, the vessel comprising:

a vessel wall having an outer surface and an inner surface spaced apart from the outer surface, the vessel wall configured to enclose an interior volume;

a first end positioned a first height above a reference plane;

a second end spaced apart from the first end, the second end being positioned a second height above the reference plane, and at a different height from the first height;

an axis that extends from the first end to the second end, the axis being configured to intersect and form an angle with a reference plane, wherein the angle is between two degrees and 20 degrees;

a fluid inlet proximate the first end through which the fluid enters the interior volume;

a fluid outlet proximate the second end through which the fluid exits the interior volume;

a port through which the reagent enters the interior volume;

at least one packing material positioned within the interior volume between the fluid inlet and the fluid outlet, the packing material configured to randomly distribute the fluid and the reagent as the fluid flows through the vessel from the fluid inlet towards the fluid outlet.

2. The vessel of claim 1, wherein the first end is positioned a first height above the reference plane and the second end being positioned a second height above the reference plane.

3. The vessel of claim 1, further comprising at least one of a fluid level sensor and a viewing port configured to provide a user with a level of the fluid within the vessel.

4. The vessel of claim 1, wherein the angle is between 5 degrees and 15 degrees.

5. The vessel of claim 1, further comprising a retention device configured to maintain at least one of a position and an orientation of the at least one packing materials within the interior volume of the vessel.

6. The vessel of claim 1, further comprising at least one of a diffuser coupled to the fluid inlet, a pressure relief valve, a fluid drain, and an auxiliary fluid inlet.

7. The vessel of claim 1, further comprising at least a plurality of packing materials and at least one sealing member positioned between adjacent packing materials.

8. The vessel of claim 1, wherein the packing material further comprises at least one of a Pall™ ring, Bialecki™ ring, Raschig™ ring, Intalox™ saddle, and Berl™ saddle.

9. The vessel of claim 1, wherein a distance from the first end of the vessel to the second end of the vessel is greater than a distance from a top of the vessel to a bottom of the vessel.

10. A vessel for mixing a fluid with a reagent as the fluid flows through the vessel, the vessel comprising:

a vessel wall having an outer surface and an inner surface spaced apart from the outer surface, the vessel wall configured to enclose an interior volume;

a first end positioned a first height above a reference plane;

a second end spaced apart from the first end, the second end being positioned a second height above the reference plane, and at a different height from the first height;

an axis that extends from the first end to the second end;

a fluid inlet proximate the first end through which the fluid enters the interior volume;

a fluid outlet proximate the second end through which the fluid exits the interior volume;

a port through which the reagent enters the interior volume;

a first packing material and at least a second packing material positioned within the interior volume between the fluid inlet and the fluid outlet, each of the first packing material and the second packing material having a first end having a packing material inlet, a second end spaced apart from the first end, the second end having a packing material outlet, the packing material outlet of the at least second packing material being positioned asymmetrically relative to the packing material outlet of the first packing material.

11. The vessel of claim 10, wherein the first height is less than the second height.

12. The vessel of claim 10, wherein the axis is configured to intersect and form an angle with the reference plane, wherein the angle is between two degrees and 20 degrees.

13. The vessel of claim 10, further comprising a first retention device and at least a second retention device, each of the first retention device and the second retention device being configured to maintain at least one of a position and an orientation of the first packing material and the second packing material, respectively, within the interior volume of the vessel.

14. The vessel of claim 10, further comprising at least one sealing member positioned between the first packing material and the second packing material.

15. The vessel of claim 10, wherein at least one of the first packing material and the at least a second packing material further comprises at least one of a Pall™ ring, Bialecki™ ring, Raschig™ ring, Intalox™ saddle, and Berl™ saddle.

16. A method of mixing a natural gas that includes an impurity at a first concentration with a stripping agent that reacts with the impurity so as to reduce the first concentration of the impurity within the natural gas to a second concentration, the mixing occurring within a vessel having a first end and a second end spaced apart from the first end, the method comprising:

introducing the natural gas into an interior volume of a vessel through a fluid inlet proximate the first end of the vessel;

introducing the stripping agent into the interior volume of the vessel through a port;

passing the natural gas and the stripping agent into a first packing material via a first packing material inlet and out of the first packing material via a first packing material outlet;

passing the natural gas and the stripping agent into at least a second packing material via a second packing material inlet and out of the second packing material via a second packing material outlet oriented asymmetrically relative to the first packing material outlet;

removing the natural gas from the interior volume via a fluid outlet port positioned downstream of the second packing material;

further comprising positioning the first end of the vessel a first height above a reference plane and positioning the second end of the vessel a second different height above the reference plane.

17. The method of claim 16, further comprising creating a pressure gradient within the natural gas between the first end and the second end of the vessel.

18. The method of claim 16, further comprising causing an axis that extends from the first end to the second end of the vessel to intersect and form an angle with a reference plane, wherein the angle is between two degrees and 20 degrees.

19. The method of claim 16, wherein at least one of the first packing material and the at least a second packing material further comprises at least one of a Pall™ ring, Bialecki™ ring, Raschig™ ring, Intalox™ saddle, and Berl™ saddle.

* * * * *